US008760976B2

(12) United States Patent
Kim

(10) Patent No.: US 8,760,976 B2
(45) Date of Patent: Jun. 24, 2014

(54) ALARM CLOCK SYSTEM

(75) Inventor: Justin Chiwon Kim, Great Neck, NY (US)

(73) Assignee: jwin Electronics Corp., Port Washington, NY (US)

( * ) Notice: Subject to any disclaimer, the term of this patent is extended or adjusted under 35 U.S.C. 154(b) by 322 days.

(21) Appl. No.: 12/820,627

(22) Filed: Jun. 22, 2010

(65) Prior Publication Data

US 2011/0310706 A1 Dec. 22, 2011

(51) Int. Cl.
*G04B 23/02* (2006.01)

(52) U.S. Cl.
USPC ..... 368/244; 368/13

(58) Field of Classification Search
USPC ..... 368/107–109, 244, 250–251, 10
See application file for complete search history.

(56) References Cited

U.S. PATENT DOCUMENTS 5,764,594 A * 6/1998 Berman et al. ..... 368/12
7,443,306 B2 * 10/2008 Randall et al. ..... 340/573.5
7,457,204 B1 * 11/2008 Winters ..... 368/73
7,573,371 B1 * 8/2009 Miller ..... 340/309.16
D605,625 S * 12/2009 Skurdal ..... D14/171
7,751,284 B2 * 7/2010 Tang ..... 368/73
7,868,743 B1 * 1/2011 Brown ..... 340/309.4
8,077,552 B1 * 12/2011 Pope et al. ..... 368/109
8,284,631 B2 * 10/2012 Cho et al. ..... 368/10
8,384,527 B2 * 2/2013 Irwin ..... 340/309.16
2005/0174889 A1 * 8/2005 Marcantonio et al. ..... 368/12
2006/0153007 A1 * 7/2006 Chester ..... 368/12
2007/0036034 A1 * 2/2007 Nanda ..... 368/12
2009/0143114 A1 * 6/2009 Vargas et al. ..... 455/574
2009/0153323 A1 * 6/2009 Nielsen et al. ..... 340/540
2009/0284389 A1 * 11/2009 Klassen et al. ..... 340/825.22
2010/0085841 A1 * 4/2010 Lazaridis et al. ..... 368/73

* cited by examiner

*Primary Examiner* — Sean Kayes

(74) *Attorney, Agent, or Firm* — Saliwanchik, Lloyd & Eisenschenk

(57) ABSTRACT

An alarm clock having a body alarm system and a satellite device is provided. The body alarm system includes a main control unit, a satellite connector, and a power supply, and the satellite device includes a satellite device satellite control unit, a body connector, an alarm signal unit, and a battery.

8 Claims, 3 Drawing Sheets

ALARM CLOCK SYSTEM

BACKGROUND

1. Field of the Invention

The disclosure generally relates to an alarm clock system and, more particularly, to an alarm clock system having a body alarm system and a satellite device.

2. Description of the Related Art

A variety of alarm clocks have already been developed and sold. Generally, most alarm clocks, however, are set to release an alarm by merely pushing a button or through simple manipulation when the alarm is raised. As such, although a user does not completely awake from sleep, the alarm is released.

To overcome this problem, alarm clocks designed to solve mazes, etc. to release an alarm have been developed. However, the release of the alarm is too complicated, so that users of various ages cannot use this alarm clock.

Alarm clocks having easy operation and a function of stopping an alarm operation at a long distance to be able to obtain a good alarming effect have been developed. Most of these alarm clocks make use of a remote controller connected by wire, or a method of releasing the alarm through voice. However, due to excessively complicated installation or interference caused by, for instance, surrounding sounds, the alarm clocks fail to produce a satisfactory effect, and require a high cost of production to encounter economic problems.

To solve this problem, there is a need for development of an alarm clock, which can awake the user without excessive surprise and is not complicated in alarming operation.

BRIEF SUMMARY

Exemplary embodiments provide an alarm clock system capable of obtaining an excellent alarming effect having a satellite device.

According to an exemplary embodiment, an alarm clock system includes a body alarm system and a satellite device. The body alarm system includes a main control unit, a satellite connector, and a power supply, and the satellite device includes a satellite control unit, a body connector, an alarm signal unit, and a battery.

The body alarm system may further include at least one of a versatile connector, a signal input unit, a sound generator, and FM tuner IC. The versatile connector may be cell phone docking and/or mp3 docking.

Further, the satellite device may further include at least one of a display and an input unit.

The alarm clock system may be preset to a turn on time when the body alarm system and the satellite device are connected to each other. Further, the satellite device is independently activated while the body alarm system and the satellite device are disconnected. On the other hand, the alarm clock system may be deactivated when the body alarm system and the satellite device are connected each other.

Meanwhile, the alarm signal unit may include at least one of a vibrator and a sound generator.

BRIEF DESCRIPTION OF THE DRAWINGS

The above and other aspects of the general inventive concept will become more readily apparent by describing in further detail example embodiments thereof with reference to the accompanying drawings, in which.

DETAILED DESCRIPTION

Figure 1:
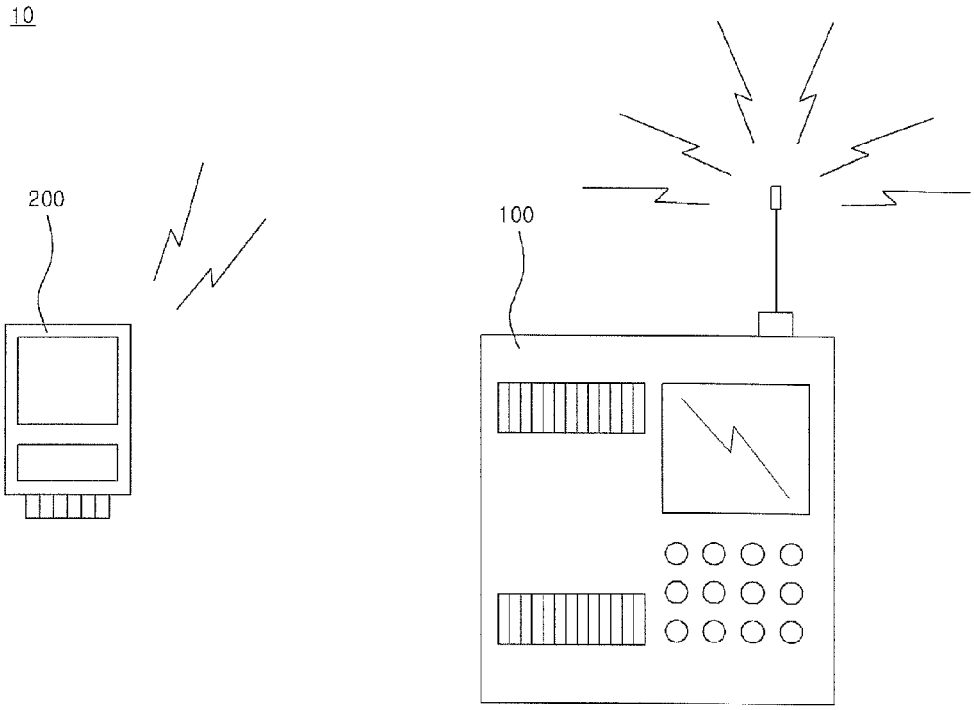
FIG. 1 schematically illustrates the external shape of an alarm clock system according to an exemplary embodiment.

The general inventive concept now will be described more fully hereinafter with reference to the accompanying drawings, in which various example embodiments are shown. This invention may, however, be embodied in many different forms, and should not be construed as limited to the example embodiments set forth herein. Rather, these example embodiments are provided so that this disclosure will be thorough and complete, and will fully convey the scope of the general inventive concept to those of ordinary skill in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated regions, integers, steps, operations, elements, and/or components, but do not preclude the presence or addition of one or more other regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein but are to include deviations in shapes that result, for example, from manufacturing. For example, a region illustrated or described as flat may, typically, have rough and/or nonlinear portions. Moreover, sharp angles that are illustrated may be rounded. Thus, the regions illustrated in the figures are schematic in nature and their shapes are not intended to illustrate the precise shape of a region and are not intended to limit the scope of the present claims.

Figure 2:
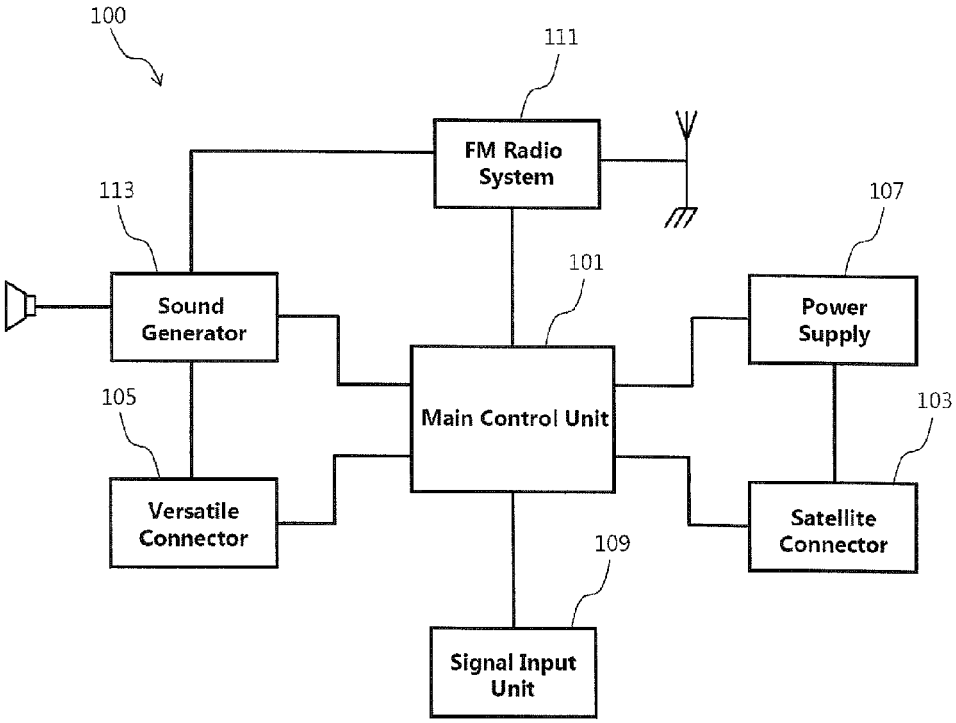
FIG. 2 is a block diagram illustrating the configuration of a body alarm system of an alarm clock system according to an exemplary embodiment.
Figure 3:
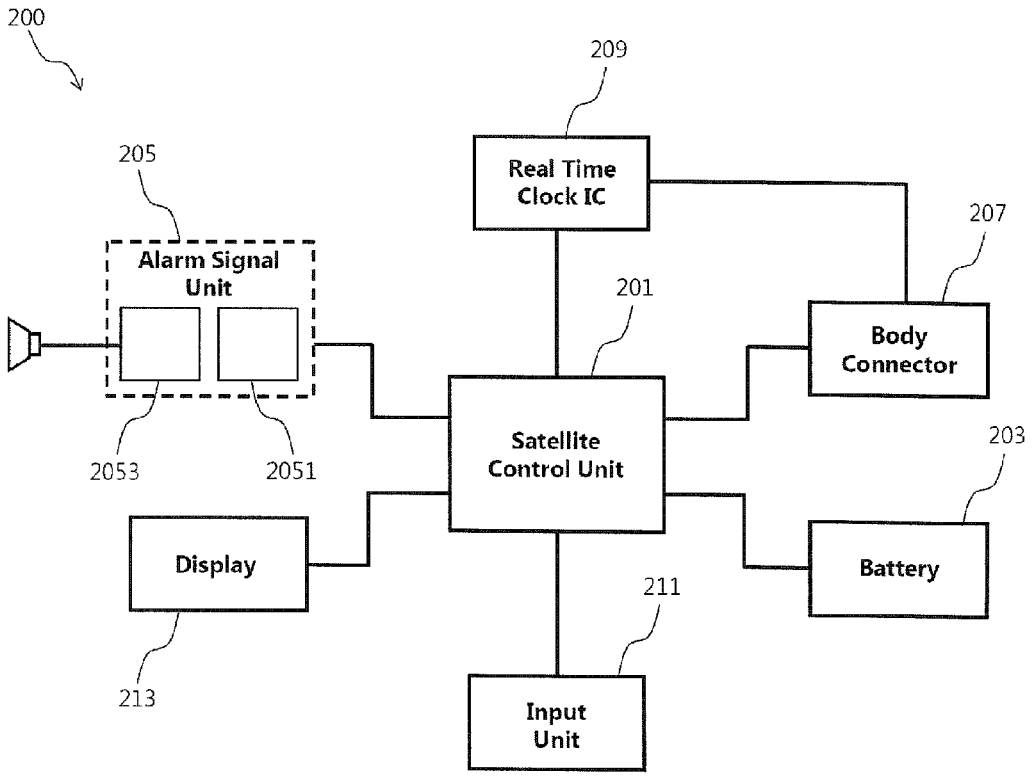
FIG. 3 is a block diagram illustrating the configuration of a satellite device of an alarm clock system according to an exemplary embodiment.
Figure 4:
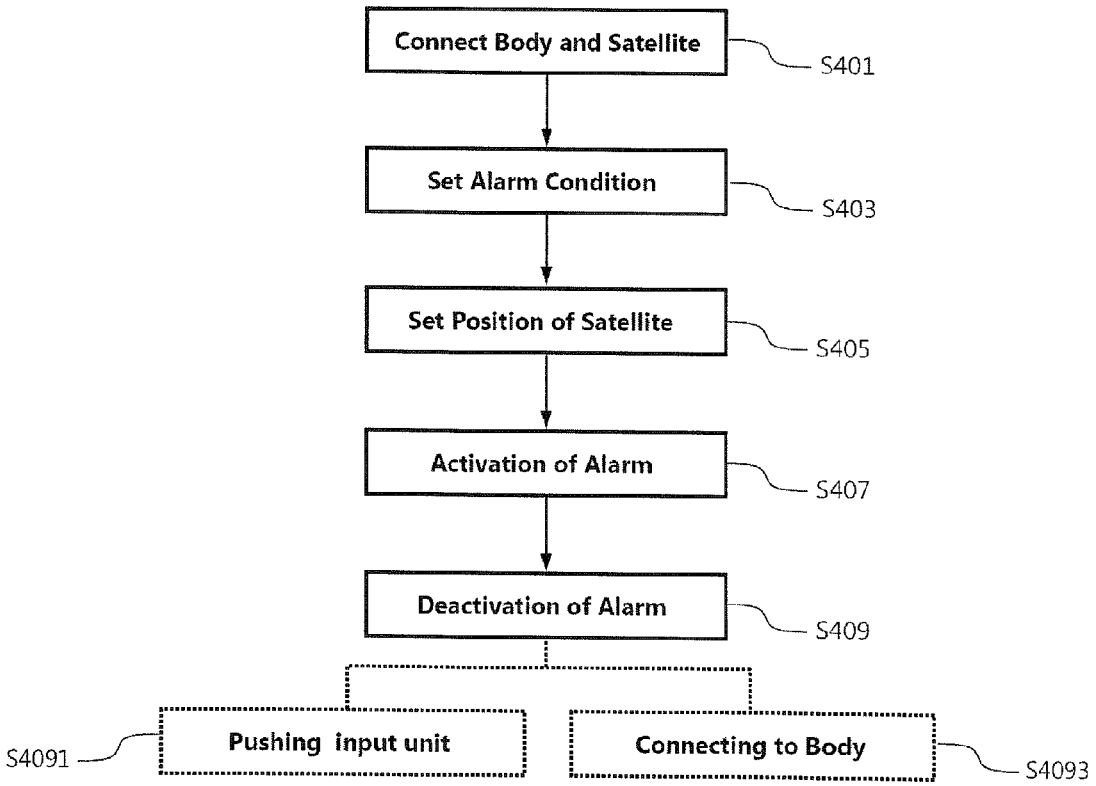
FIG. 4 is a flowchart illustrating a method of using an alarm clock system according to an exemplary embodiment.

FIG. 1 schematically illustrates the external shape of an alarm clock system according to an exemplary embodiment, FIG. 2 is a block diagram illustrating the configuration of a body alarm system of an alarm clock according to an exemplary embodiment, and FIG. 3 is a block diagram illustrating the configuration of a satellite device of an alarm clock according to an exemplary embodiment.

Referring to FIGS. 1 to 3, an alarm clock system 10 according to an exemplary embodiment includes a body alarm system 100 and a satellite device 200. One or more satellite devices 200 may be simultaneously connected to one body alarm system. However, for the sake of convenience, only one satellite device 200 is illustrated.

The configuration of the body alarm system 100 according to an exemplary embodiment will be described with reference to FIGS. 1 and 2.

The body alarm system 100 includes a main control unit 101, a satellite connector 103, a versatile connector 105, a power supply 107, a signal input unit 109, a FM radio system 111 and a sound generator 113.

The main control unit 101 is electrically connected to each part of the body alarm system 100, and controls each device and data. The main control unit 101 may use a variety of microprocessors, and be formed by a combination of one or more microprocessors. The main control unit 101 such as a micro controller unit (MCU) provides the alarm clock control information to the satellite device 200 using a satellite connector 103 while it is connected.

The satellite connector 103 is used to physically and electrically connect the satellite device 200 (see FIG. 3) to the body alarm system 100. The satellite device 200 communicates with the body alarm system 100 through the satellite connector 103, and is supplied with power for charging a battery 203 thereof (see FIG. 3). The satellite connector 103 may be a coaxial cable. While the satellite device 200 is connected via the satellite connector 103, it could be programmed and thereby store an alarm clock control information. Once the satellite device 200 is programmed properly, it could be located anywhere to provide an alarm without any distance limitation.

The versatile connector 105 is used to electrically connect the body alarm system 100 with various devices other than the satellite device 200. Through the versatile connector 105, the alarm clock 10 may connect a mobile phone, an MP3 player, etc., and reproduce music stored in each device through the body alarm system 100 or the satellite device 200. The versatile connector 105 functions to electrically connect the various devices with the body alarm system 100 and makes it possible to exchange the data. The versatile connector 105 may include various terminals corresponding to the devices to be connected. The versatile connector 105 may include a cell phone docking and/or mp3 docking. For example, a universal serial bus (USB) port to connect the MP3 player, and dedicated connection terminals for iPhone® and iPod® to connect the iPhone® and iPod®. In this manner, the alarm clock system 10 according to an exemplary embodiment has an advantage in that it has the versatile connector 105 to be able to reproduce music stored in the various devices or use it as the alarm.

The power supply 107 supplies power to each part of the body alarm system 100 through the main control unit 101. Alternatively, the power supply 107 may be directly, electrically connected to each part so as to supply the power. The power supply 107 may supply the power using an external power source or a battery. The power supply 107 includes an AC-DC or DC-DC down converter for converting external high voltage into low voltage used for each part of the body alarm system 100, and a DC-DC up converter for raising the voltage of the battery to proper voltage. These components have already been well known to those skilled in the art, and thus their detailed descriptions will be omitted.

The signal input unit 109 receives an input of the user to input required for the alarm, and settings for raising or releasing the alarm. The signal input unit 109 includes a button composed of a plurality of key pads. Alternatively, the signal input unit 109 may include various devices such as a touch screen, a dial, etc. through which the user can input the corresponding settings. The signal input unit 109 is connected to the main control unit 101, and transmits data for the various settings input by the user to the main control unit 101.

The FM radio system 111 contains the FM antenna and FM tuner IC. The FM radio wave could be provided to the body alarm system. The FM radio wave may turn on/off by signal input unit 109.

The sound generator 113 is electrically connected to the main control unit 101, and reproduces the sound generated from the main control unit 101 or the sound stored in the device, e.g. the MP3 player, connected to the versatile connector 105. The sound generator 113 may include a music sound IC, an amplifier for amplifying the sound and a speaker. Here, the amplifier is not an essential component. According to a required output, the amplifier and the speaker may constitute the sound generator 113. The music sound IC could be connected to the main control unit 101 and generate a music sound to wake the user up smoothly through a sound generator 113. This music sound IC also could generate several natural sounds like a farm animal sound, a rain sound, and a wind sound. A preamplifier (NOT shown) may amplify the audio input to supply the right audio volume level to volume control unit and the main audio amplifier 113. A volume control & audio input control unit (NOT shown) could control the body alarm system volume level as well as the multiple audio input signals like an auxiliary audio input, cell phone docking audio input and a FM radio input. The sound generator 113 is connected to the versatile connector 105, the FM tuner IC 111, and the music sound IC via the preamplifier and/or volume control & audio input control unit.

Next, the satellite device 200 of the alarm clock system 10 according to an exemplary embodiment will be described with reference to FIGS. 1 and 3.

The satellite device 200 according to an exemplary embodiment includes a satellite control unit 201, a body connector 207, an alarm signal unit 205, a battery 203, an input unit 211, and a display 213. The satellite device 200 is not using a wireless module for the data transmission. The pre-determined timing configuration is stored in the satellite device memory while it is attached and connected to the body alarm system 100. This satellite device 200 could provide the alarm alone or together with the body alarm system by the predetermined setting while it is connected to the body alarm system 100.

The satellite control unit 201 is electrically connected to each part of the satellite device 200, and controls a device(s) and a flow of data of each part. The satellite control unit 201 could be programmed by satellite control unit program connector. The satellite control unit 201 may use a variety of microprocessors, timer IC (integrated circuit) or a micro controller unit (MCU) and be formed by a combination of one or more microprocessors. The satellite control unit 201 is connected with body connector 207, battery 203, and real time clock IC 209, and thus controls configuration data and supplies power to the satellite control unit 201 as well as the whole system. The configuration data can communicate through a serial 12C interface bus to reduce the connector pins and the signal error rate, thereby reducing the signal paths as well as to increase the signal tolerance. Further, the real time clock IC 209 will be supplied to the satellite control unit 201 through a serial bus. It is accomplished that a crystal clock providing the clock signal is connected to the real time clock IC 209 via the satellite control unit 201 by a serial bus.

The battery 203 supplies power to each part of the satellite device 200. The battery 203 is electrically connected to the body connector 207 via the satellite control unit 201. Thus, it is automatically charged while the satellite device 200 is connected to the body alarm system 100. The battery 203 includes a rechargeable lithium-ion, lithium-polymer, nickel-cadmium cell, or the regular dry cell battery, and a safety circuit. The safety circuit serves to prevent the cell from being overcharged while the cell is being charged. The battery 203 may include a plurality of cells depending on the required voltage. If the safety circuit is mounted in the cell, the safety circuit may be omitted.

The alarm signal unit 205 provides an alarm to a user, and includes a vibrator 2051 and a sound generator 2053. The vibrator 2051 for the vibration alarm may be a motor. The sound generator 2053 contains a music sound IC which generates the music or a voice indicating the current clock time via a speaker. The alarm signal unit 205 is connected to the satellite control unit 201, and drives the vibrator 2051 to generate vibration according to previous input alarm setting, or generates the alarm through the sound generator 2053. The alarm signal unit 205 may simultaneously or sequentially generate the vibration and the sound according to setting. Since the user may place and use the satellite device 200 at a desired place, it is possible to generate the vibration and the alarm sound from the satellite device 200 and to maximize an alarming effect. However, it is not essential to include both the vibrator 2051 and the sound generator 2053. Only one of them may be installed as needed, and according to the size of the satellite device 200.

The body connector 207 electrically connects the satellite device 200 to the body alarm system 100. Through the body connector 207, the satellite device 200 could be connected to the body alarm system to preset a turn on time. The body connector 207 may be a coaxial cable and connected to satellite control unit 201 via a serial 12C interface to reduce the signal paths as well as to increase the signal tolerance. Further, as described above, the body connector 207 is directly connected to the battery 203, or connected to the battery 203 via the satellite control unit 201, and transmits the power supplied from the body alarm system 100 to the battery 203. The body connector 207 may be an attachable connector which can be connected to the body alarm system 100 through a surface contact pad connector. In this case, it can be connected and detached easily and the alarm timer setting the alarm signal should be configured while the body alarm system 100 is connected.

The input unit 211 may provide the user input to stop the alarm signal or display the current time. The alarm may be set to release the alarm in such a manner that the user pushes a button of the input unit 211. In this case, the alarm may be released in such a simple manner that the user pushes a button of the satellite device 200.

The display 213 displays information such as a current time, and is composed of a black-and-white or color liquid crystal display (LCD) such as 7 Digit LED, organic light emitting diode (OLED), or the like. The current time will be displayed in the display 213 requested by the input unit 211, and an NPN transistor will control the display 213. The display 213 is electrically connected to the satellite control unit 201, and controlled through the satellite control unit 201. The display 213 displays information about the set alarm, information about the current time, information about the available residual power of the battery, and so on. The display 213 may be removed as needed or depending on the size of the satellite device 200. The information about the set alarm, information about the current time, information about the available residual power of the battery, etc. may be displayed using one or more LEDs.

In this manner, the alarm clock system 10 according to an exemplary embodiment has the body 100 and the satellite device 200, so that it can provide the alarm to the user with high efficiency without an influence on the surrounding wireless devices. Further, the alarm clock system 10 according to an exemplary embodiment may dispose the satellite device 200 irrespective of place. Thus, the user can recognize the alarm without great surprise.

Next, a method of using the alarm clock system 10 according to an exemplary embodiment will be described with reference to FIGS. 1 to 4.

First, the body alarm system 100 and the satellite device 200 are electrically interconnected through the respective connectors 103 and 207 (S401). The satellite device batteries 203 could be recharged while it is connected to the body alarm system 100.

Next, alarm conditions are preset through the signal input unit 109 of the body alarm system while the body alarm system 100 and the satellite device 200 are interconnected (S403). In detail, the turn on time and/or an alarm signal (vibration and/or sound) are preset. Also, by the predetermined setting, the satellite device 200 could provide the alarm alone or together with the body alarm system 100. If the versatile connector 105 is equipped with another device in which music is stored, the stored music may be set to be used as the alarm signal. Here, the alarm preset conditions are transmitted from the body alarm system 100 to the satellite device 200 through electrical connection. That is, the data of predetermined setting is transmitted through direct connection between the body alarm system 100 and the satellite device 200.

Subsequently, the satellite device 200 could be located anywhere without the limitation of the distance to the body alarm system 100 (S405). The satellite device 200 smoothly operates even at a position where it is spaced apart from the body alarm system 100. The satellite device 200 could be positioned in the blanket, under the pillow, or in the pocket. The user could be alarmed while the user is in the shopping mall even if far from the home. The satellite device 200 can display or voice the current time by the input unit 211 such as a push button.

When the preset conditions are met, the alarm is activated through the satellite device 200 and/or the body alarm system 100 (S407). The alarm signal could be either vibration, sound music or both. To avoid the startling alarm sound when the alarm is activated, the satellite device 200 could be vibrated at the initial wakening period such as 1 minute. The alarm signal could be repeated several times by preset conditions until it is attached to the local alarm system.

Next, the alarm is deactivated according to the preset conditions (S409). According to the presetting alarm condition (S401), the alarm may be deactivated by pushing the input unit 211 of the satellite device 200 (S4091), or be deactivated only when the satellite device 200 is connected to the body alarm system 100 (S4093). In the latter case, the user should get out of bed, walk to the body alarm system 100, and then connect the satellite device 200 to the body alarm system 100 to turn off the alarm. To connect the satellite device 200 to the body alarm system 100, the user must completely awake from sleep.

An alarm clock system according to an exemplary embodiment includes a satellite device. A user may dispose the satellite device at a desired position. Thus, the alarm may be generated near the user using the vibration and sound.

Further, the alarm may be set to be released only when the satellite device is connected to the body alarm system. If the alarm is set in this way, the alarm is released only when the user connects the satellite device and the body alarm system. To connect the satellite device and the body alarm system, the user must completely awake from sleep. Thus, when the alarm clock system according to an exemplary embodiment is used to awake from sleep, it is possible to awake the sleep of the user with high efficiency.

Also, the body alarm system 100 of the alarm clock system according to an exemplary embodiment further comprising FM antenna and FM tuner IC which could provide the FM radio wave to the body alarm system.

In addition, in the alarm clock system according to an exemplary embodiment, the body alarm system includes a versatile connector. Through the versatile connector, the body alarm system could be connected with an MP3 player or a cell phone. For example, the versatile connector is a cell phone docking connector which could be synchronized with any general smart phone equipped in MP3 player like iPhone®, iPod®, or Blackberry®.

Meanwhile, the alarm clock system according to an exemplary embodiment can be configured of a simple circuit, so that it can be easily fabricated, and be produced at a low cost. Further, the alarm clock system does not use a complicated circuit, so that it can reduce occurrence of failure.

The alarm clock system according to an exemplary embodiment could provide the comfortable waken signal to the user without any big surprise by vibration or smoothing music from the wireless satellite device nearby the user's body.

Further, the alarm clock system according to an exemplary embodiment could simplify the satellite device with an electrical control system which can be used to require sufficient effort and concentration by the user when he attempts to deactivate the clock alarm accomplishing the intended purpose of the alarm.

Further, the alarm clock system according to an exemplary embodiment could provide an improved wireless clock alarm system which has an alarm deactivating arrangement without having excessively complicated circuitry, avoiding the wireless signal interference especially with a cellular phone, and improve the reliability in wireless operation.

Further, the alarm clock system according to an exemplary embodiment could improve system being relatively simple in construction, involving inexpensive and readily available components, and having a wide range of versatility in usage in that it can be arranged either with a wireless satellite device or a local alarm system.

Further, the alarm clock system according to an exemplary embodiment could provide an improved electrical clock alarm system wherein deactivation of its wireless satellite alarm device with no distance limitation and perform a simple but positive act without any failure due to the wireless interference error.

The general inventive concept should not be construed as being limited to the example embodiments set forth herein. Rather, these example embodiments are provided so that this disclosure will be thorough and complete and will fully convey the concept of the present invention to those of ordinary skill in the art.

What is claimed is:

1. An alarm clock system comprising:

a body alarm system comprising a main control unit, a satellite connector, and a power supply; and a satellite device comprising a satellite control unit, a body connector, an alarm signal unit, and a battery;

wherein a preset turn on time for an alarm signal output from the satellite device is set using the body alarm system, wherein the preset turn on time set using the body alarm system is transmitted from the body alarm system to the satellite device while the body alarm system and the satellite device are connected to each other, wherein the satellite device stores the preset turn on time transmitted from the body alarm system, an wherein the satellite control unit controls the turn on of the alarm signal output according to the stored preset turn on time, wherein the alarm signal output from the satellite device activates while the body alarm system and the satellite device are disconnected, wherein reconnection of the body alarm system and the satellite device to each other deactivates the alarm signal output from the satellite device, and wherein the alarm signal output from the satellite device can be set to deactivate only when the satellite device is reconnected to the body alarm system.

2. The alarm clock system according to claim 1, wherein the body alarm system further comprises at least one of a versatile connector, a signal input unit, a sound generator, and FM radio system.

3. The alarm clock system according to claim 2, wherein the versatile connector is a cell phone docking connector and/or an mp3 docking connector.

4. The alarm clock system according to claim 1, wherein the satellite device further comprises a display, an input unit, and real time clock IC.

5. The alarm clock system according to claim 1, wherein the alarm signal unit comprises a vibrator and/or a sound generator.

6. The alarm clock system according to claim 1, wherein the satellite device further comprises an input unit, wherein a user input to the input unit also deactivates the alarm signal output from the satellite device.

7. The alarm clock system according to claim 1, wherein alarm settings including the preset alarm condition are transmitted from the body alarm system to the satellite device through direct physical connection between the satellite device and the body alarm system, and wherein the satellite device is configured to separately from the body alarm system generate the alarm signal according to the preset alarm condition.

8. The alarm clock system according to claim 1, wherein the body alarm system further comprises a versatile connector for connecting a mobile phone or mp3 player and enabling music stored on the mobile phone or mp3 player to be played or replayed via the satellite device or the body alarm system.

* * * * *

UNITED STATES PATENT AND TRADEMARK OFFICE

CERTIFICATE OF CORRECTION

PATENT NO. : 8,760,976 B2
APPLICATION NO. : 12/820627
DATED : June 24, 2014
INVENTOR(S) : Justin Chiwon Kim It is certified that error appears in the above-identified patent and that said Letters Patent is hereby corrected as shown below:

In the Claims

Column 8, Claim 1,
Line 44, "system, an wherein" should read --system, wherein--.

Signed and Sealed this
Ninth Day of December, 2014

Michelle K. Lee

Michelle K. Lee
*Deputy Director of the United States Patent and Trademark Office*